US010060012B2

(12) United States Patent
Schloffer

(10) Patent No.: US 10,060,012 B2
(45) Date of Patent: Aug. 28, 2018

(54) HIGH-TEMPERATURE TIAL ALLOY

(71) Applicant: MTU Aero Engines AG, Munich (DE)

(72) Inventor: Martin Schloffer, Munich (DE)

(73) Assignee: MTU AERO ENGINES AG, Munich (DE)

( * ) Notice: Subject to any disclaimer, the term of this patent is extended or adjusted under 35 U.S.C. 154(b) by 630 days.

(21) Appl. No.: 14/612,504

(22) Filed: Feb. 3, 2015

(65) Prior Publication Data

US 2015/0218675 A1 Aug. 6, 2015

(30) Foreign Application Priority Data

Feb. 20, 2014 (EP) ..... 14154052

(51) Int. Cl.

| | |
|---|---|
| ***C22C 14/00*** | (2006.01) |
| ***B22D 21/00*** | (2006.01) |
| ***C22C 30/00*** | (2006.01) |
| ***B22D 27/04*** | (2006.01) |
| ***B22D 21/02*** | (2006.01) |
| ***C22C 1/04*** | (2006.01) |
| ***C22C 27/02*** | (2006.01) |
| ***C22C 1/00*** | (2006.01) |
| ***C22F 1/18*** | (2006.01) |
| ***B22F 9/04*** | (2006.01) |

(52) U.S. Cl.

CPC ..... *C22C 14/00* (2013.01); *B22D 21/022* (2013.01); *B22D 27/045* (2013.01); *B22F 9/04* (2013.01); *C22C 1/00* (2013.01); *C22C 1/0458* (2013.01); *C22C 1/0491* (2013.01); *C22C 27/02* (2013.01); *C22C 30/00* (2013.01); *C22F 1/183* (2013.01); *B22F 2009/041* (2013.01)

(58) Field of Classification Search

CPC ..... C22C 14/00; C22C 1/0458; C22C 1/048; B22D 21/022

See application file for complete search history.

(56) References Cited

U.S. PATENT DOCUMENTS 4,716,020 A * 12/1987 Blackburn ..... C22C 14/00 148/407
2010/0316525 A1 12/2010 Shindo et al.

FOREIGN PATENT DOCUMENTS

| | | | |
|---|---|---|---|
| EP | 2251445 | A1 | 11/2010 |
| JP | 2002356729 | A | 12/2002 |
| WO | 2012041276 | A2 | 4/2012 |

OTHER PUBLICATIONS

Martin Schloffer et al, "Evolution of the omega phase in a beta-stabilized multi-phase TiAl alloy and its effect on hardness", ACTA Materialia, vol. 64, Nov. 19, 2013, pp. 241-252.*
Martin Schloffer et al., "Evolution of the wo phase in a B-stabilized multi-phase TiAl alloy and its effect on hardness", ACTA Materialia, vol. 64, Nov. 19, 2013, pp. 241-252.
Tetsui T et al.: "Fabrication of TiAl components by means of hot forging and machining", Intermetallics, Elsevier Science Publishers B.V, GB, vol. 13, No. 9, Sep. 1, 2005, pp. 971-978.
Witusiewicz et al: "The Al—B—Nb—Ti system: III. Thermodynamic re-evaluation of the constituent binary system Al—Ti", J. Alloys Compd., vol. 465, Oct. 22, 2007 (Oct. 22, 2007), pp. 64-77.
Witusiewicz et al: "The Al—B—Nb—Ti system: IV. Experimental study and thermodynamic re-evaluation of the binary Al—Nb and ternary Al—Nb—Ti systems", J. Alloys Compd., vol. 472, Jun. 30, 2008 (Jun. 30, 2008), pp. 133-161.
H. F. Chladil et al; "Characterization of a [beta]-Solidified [gamma]-TiAl alloy", BHM Berg-Und Hüttenmännische Monatshefte, vol. 151, No. 9, Sep. 1, 2006 (Sep. 1, 2006), pp. 356-361.
Liu et al: Thermodynamic description of niobium-rich gamma-TiAl alloys, Int. J. Mat. Res., vol. 102, No. 6, Jun. 30, 2011 (Jun. 30, 2011), pp. 692-696.

* cited by examiner

*Primary Examiner* — George Wyszomierski
*Assistant Examiner* — Janelle Morillo
(74) *Attorney, Agent, or Firm* — Abel Law Group, LLP

(57) ABSTRACT

The present invention relates to a TiAl alloy for use at high temperatures having the main constituents titanium and aluminum and having a proportion of aluminum of greater than or equal to 30 at. % and a matrix composed of β phase and precipitates of ω phase embedded in the matrix, with the β phase and the ω phase together making up at least 55% by volume of the microstructure, and also a process for the production thereof and the use thereof.

20 Claims, No Drawings

HIGH-TEMPERATURE TIAL ALLOY

BACKGROUND OF THE INVENTION

Field of the Invention

The following invention relates to a TiAl alloy for use at high temperatures, in particular in the range from 750° C. to 900° C., and also to the production and use thereof.

Discussion of Background Information

Alloys based on intermetallic titanium aluminide compounds are employed in the construction of stationary gas turbines or aircraft engines, for example as material for turbine blades, since they have the mechanical properties necessary for use and additionally have a low specific gravity, so that the use of such alloys can increase the efficiency of stationary gas turbines and aircraft engines.

Accordingly, many TiAl alloys have already been developed, with use at present being made of, in particular, TiAl alloys which are based on the intermetallic γ-TiAl phase and are alloyed with niobium and molybdenum or boron and are therefore referred to as TNM or TNB alloys. Such alloys have titanium as main constituent together with from about 40 to 45 at. % of aluminum, about 5 at % of niobium and, for example, 1 at % of molybdenum and also small proportions of boron. The microstructure is characterized by a high proportion of γ-TiAl and likewise significant proportions of $\alpha_2$-$Ti_3Al$, with further phases such as the β phase or B19 phase being able to occur in a relatively small proportion.

The known TNM or TNB alloys based on γ-TiAl usually have an equiaxial γ-TiAl microstructure, a lamellar microstructure or a duplex microstructure with equiaxial γ-TiAl grains and lamellar regions composed of γ-TiAl and $\alpha_2$-$Ti_3Al$. Although such γ-TiAl alloys, especially those having lamellar microstructures, have very good overall mechanical properties up to 750° C., a deterioration in the mechanical properties, in particular a decrease in the creep resistance, occurs at higher temperatures because of the thermodynamic instability of the microstructure.

It is therefore an object of the present invention to provide an alloy which has a low specific gravity similar to that of the known γ-TiAl alloys and also comparable mechanical properties, in particular at high temperatures, with the use range preferably being broadened to temperatures in the range from 750° C. to 900° C. or 950° C. Such an alloy should be able to be produced and processed on an industrial scale without undue difficulty and also be able to be used reliably in stationary gas turbines and aircraft engines.

SUMMARY OF THE INVENTION

The present invention provides a TiAl alloy, a process for producing a TiAl alloy and also the use of the TiAl alloy as set forth in the instant independent claims. Further advantageous embodiments are subject matter of the dependent claims.

In the following, a TiAl alloy is an alloy whose main constituents are titanium and aluminum, so that the proportion of aluminum and titanium in at. % or % by weight is in each case greater than the proportion of any other alloy component. However, in at. % or % by weight, it is possible for the proportion of aluminum to be greater than the proportion of titanium, not only for the proportion of titanium to be greater than the proportion of aluminum as the designation TiAl appears to indicate. In addition, a TiAl alloy according to the invention is an alloy which is made up predominantly of intermetallic phases having the constituents titanium and/or aluminum.

The present invention accordingly proposes a TiAl alloy as high-temperature TiAl alloy comprising, apart from the main constituents titanium and aluminum, in particular a main constituent titanium, a proportion of aluminum of ≥30 at. % and in which the microstructure has a matrix composed of β phase in which precipitates of ω phase are embedded.

The term β phase refers to various morphologies of the β phase, e.g. β or $\beta_0$. Analogously, the ω phase encompasses various morphologies such as $\omega_0$-$B8_2$, ω-$D8_8$ or ω" transition phases.

The proportion by volume of the β phase and the ω phase should together be at least 55% by volume, preferably at least 75% by volume and in particular at least 80% by volume. The creep resistance, in particular, can be improved by a microstructure having a matrix of β phase with embedded ω precipitates, so that higher use temperatures compared to the known γ-TiAl alloys are possible. Owing to the matrix composed of β phase, the corresponding alloy can also be referred as β-TiAl alloy.

The proportion by volume of β phase to ω phase can be in the range from 1 to 4 to 4 to 1, in particular from 1 to 3 to 3 to 1.

The ω phase can precipitated with grain sizes in the range from 5 nm to 500 nm, in particular from 10 nm to 450 nm or from 25 nm to 400 nm, and be present in this form in the β matrix. In addition, the ω phase can also be present in, in particular, globular form at grain boundaries of the TiAl alloy, with grain boundaries of all possible microstructure constituents coming into question here.

For this purpose, the alloy can be subjected to at least one heat treatment lasting for from 1 to 100 hours at a temperature in the range from 20° C. below to 400° C. below the ω-solvus temperature, so that a thermodynamically stable microstructure is established. Precipitation of ω phases having small grain sizes in the nm range can, in particular, exert an advantageous influence on the strength properties.

The precipitation of the ω phase can also be carried out in such a way that the ω phase is present in at least two different grain size ranges in the microstructure, with a first grain size range being able to encompass grain sizes in the range from 5 nm to 100 nm and a second grain size range being able to encompass grain sizes in the range from 200 nm to 500 nm. Multistage aging heat treatments can be carried out for this purpose.

Various deformation mechanisms in the alloy can be suppressed as a function of the various grain sizes of the ω phases in order to increase the strength of the alloy. Thus, the ω precipitates having relatively large grain sizes can hinder cutting by means of dislocations, while the smaller ω precipitates can hinder climbing-over by the dislocations.

The ω phase can be present as semicoherent in spherical or cubic form in the β matrix, with the β matrix being able to have a network-like microstructure which makes a high creep resistance up to temperatures of 900° Celsius and more possible.

As alloy constituents, it is possible for one or more alloying elements from the group including niobium, molybdenum, tungsten, zirconium, vanadium, yttrium, hafnium, silicon, carbon and cobalt to be alloyed in. The alloy components niobium, molybdenum, tungsten, zirconium and cobalt are particularly advantageous since they stabilize the β phase. The alloy constituents niobium and molybdenum can, in particular, be provided in a ratio of from 1.8 to 1 to 5 to 1, preferably from 2 to 1 to 3 to 1, relative to one another in the alloy, so that the niobium content is always higher than the molybdenum content. The higher the proportion of niobium and molybdenum in the alloy, the higher can the ratio of niobium to molybdenum be chosen in order to promote precipitation of the ω phase. A relatively high proportion of niobium makes formation of the ω phase possible since niobium stabilizes ω phase formation while molybdenum essentially makes formation of the β phases possible.

The alloy components tungsten, zirconium, vanadium, yttrium and hafnium serve to form oxides and carbides which can form finely divided precipitates, so that these alloy constituents can not only aid mixed crystal stabilization but also contribute to the formation of precipitates to increase the strength of the alloy. Correspondingly, the alloy constituents tungsten, zirconium, vanadium, yttrium and hafnium can be at least partly interchanged. The same applies to the alloy constituents tungsten, vanadium and cobalt on the one hand and zirconium, yttrium and hafnium on the other hand.

The addition of cobalt can bring about a further increase in the creep resistance since the alloying element cobalt can reduce the stacking fault energy, so that splitting of dislocations occurs and makes climbing of the dislocations more difficult and thus increases the creep resistance.

The addition of silicon can improve the corrosion resistance of the alloy.

Accordingly, a β-TiAl alloy according to the invention can comprise from 30 to 42 at. % of aluminum, in particular from 30 to 35 at. % of aluminum, from 5 to 25 at. % of niobium, in particular from 15 to 25 at. % of niobium, from 2 to 10 at. % of molybdenum, in particular from 5 to 10 at. % of molybdenum, from 0.1 to 10 at. % of cobalt, in particular from 5 to 10 at. % of cobalt, from 0.1 to 0.5 at. % of silicon and from 0.1 to 0.5 at. % of hafnium, with titanium as balance. The individual alloy constituents should be selected within the content ranges indicated above so that they add up to a total of 100%. Accordingly, each content range indicated does not necessarily have to be completely exploited. Rather, this depends on which alloy constituents have already been selected in which proportion, so that the content ranges have a mutual influence on one another.

The TiAl alloy presented can be produced pyrometallurgically, with the melt being able to be drawn out as a single crystal or cast to form a polycrystalline product, so that the corresponding component composed of the β-TiAl alloy can be used as a single crystal, as a directionally solidified component or as a polycrystalline component.

In addition, powder-metallurgical production in which at least part of the alloy constituents, for example the alloying elements cobalt, tungsten, hafnium, vanadium and yttrium, can be mechanically alloyed is also possible.

To form the ω precipitates, the alloy can be subjected to single-stage or multistage aging heat treatments which are carried out in the temperature range from 20° C. below to 400° C. below the ω-solvus temperature at which the co phase goes into solution.

A corresponding TiAl alloy can, in particular, be used for components of stationary gas turbines or aircraft engines, for example for turbine blades.

What is claimed is:

1. A TiAl alloy for use at high temperatures, wherein the alloy comprises:

from 30 to 42 at. % of Al
from 5 to 25 at. % of Nb
from 2 to 10 at. % of Mo
from 0.1 to 10 at. % of Co
from 0.1 to 0.5 at. % of Si
from 0.1 to 0.5 at. % of Hf,
balance Ti, and wherein the alloy comprises a matrix of β phase and precipitates of ω phase embedded in the matrix, the β phase and the ω phase together making up at least 55% by volume of a microstructure of the alloy.

2. The TiAl alloy of claim 1, wherein the β phase and the ω phase together make up at least 75% by volume of the microstructure.

3. The TiAl alloy of claim 1, wherein the β phase and the ω phase are present in the microstructure in a volume ratio of greater than 1:4 and less than 4:1, relative to one another.

4. The TiAl alloy of claim 1, wherein the ω phase is present with grain sizes ranging from 5 nm to 500 nm.

5. The TiAl alloy of claim 1, wherein the ω phase is present in the microstructure with grain sizes in at least two different grain size ranges, a first grain size range encompassing grain sizes from 5 nm to 100 nm and a second grain size range encompassing grain sizes from 200 nm to 500 nm.

6. The TiAl alloy of claim 1, wherein the β matrix has a network-like microstructure.

7. The TiAl alloy of claim 1, wherein the alloy comprises:

from 30 to 35 at. % of Al
from 15 to 25 at. % of Nb
from 5 to 10 at. % of Mo
from 5 to 10 at. % of Co
from 0.1 to 0.5 at. % of Si
from 0.1 to 0.5 at. % of Hf,
balance Ti.

8. A process for producing the TiAl alloy of claim 1, wherein the process comprises producing the alloy pyrometallurgically and drawing it as a single crystal or casting it to form a polycrystalline product or comprises producing the alloy at least partly powder-metallurgically.

9. A component of a flow machine, wherein the component comprises the alloy of claim 1.

10. A TiAl alloy for use at high temperatures, wherein the alloy comprises titanium and aluminum as main constituents, a proportion of aluminum being greater than or equal to 30 at. %, and additionally comprises Nb and Mo in proportions in at. % of from 2:1 to 3:1, and wherein the alloy comprises a matrix of β phase and precipitates of w phase embedded in the matrix, the β phase and the ω phase together making up at least 55% by volume of a microstructure of the alloy.

11. The TiAl alloy of claim 10, wherein the β phase and the ω phase together make up at least 75% by volume of the microstructure.

12. The TiAl alloy of claim 10, wherein the β phase and the ω phase are present in the microstructure in a volume ratio of greater than 1:4 and less than 4:1, relative to one another.

13. The TiAl alloy of claim 10, wherein the ω phase is present with grain sizes ranging from 5 nm to 500 nm.

14. The TiAl alloy of claim 10, wherein the ω phase is present in the microstructure with grain sizes in at least two different grain size ranges, a first grain size range encompassing grain sizes from 5 nm to 100 nm and a second grain size range encompassing grain sizes from 200 nm to 500 nm.

15. The TiAl alloy of claim 10, wherein the β matrix has a network-like microstructure.

16. The TiAl alloy of claim 10, wherein the alloy further comprises at least one element selected from W, V, and Co.

17. The TiAl alloy of claim 10, wherein the alloy further comprises at least one element selected from Zr, Y, and Hf.

18. The TiAl alloy of claim 10, wherein the alloy comprises:

from 30 to 42 at. % of Al
from 5 to 25 at. % of Nb
from 2 to 10 at. % of Mo
from 0.1 to 10 at. % of Co
from 0.1 to 0.5 at. % of Si
from 0.1 to 0.5 at. % of Hf,
balance Ti.

19. A process for producing the TiAl alloy of claim 10, wherein the process comprises producing the alloy pyrometallurgically and drawing it as a single crystal or casting it to form a polycrystalline product or comprises producing the alloy at least partly powder-metallurgically.

20. A component of a flow machine, wherein the component comprises the alloy of claim 10.

* * * * *